US007600628B2

(12) United States Patent
González Alemany et al.

(10) Patent No.: US 7,600,628 B2
(45) Date of Patent: Oct. 13, 2009

(54) CARRIAGE FOR DRIVING HANDRAILS OF WALKWAYS AND MOVING STAIRS

(75) Inventors: Miguel Angel González Alemany, Oviedo (ES); Juan Domingo Gonzalez Pantiga, Gijón (ES); Manuel Alonso Cuello, Gijón (ES)

(73) Assignees: Thyssenkrupp Norte, S.A., Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 116 days.

(21) Appl. No.: 11/965,335

(22) Filed: Dec. 27, 2007

(65) Prior Publication Data

US 2008/0164121 A1 Jul. 10, 2008

(30) Foreign Application Priority Data

Dec. 29, 2006 (ES) ..... 200603323

(51) Int. Cl.
*B66B 23/04* (2006.01)

(52) U.S. Cl. ..... 198/334; 198/331; 198/335

(58) Field of Classification Search ..... 198/331, 198/334, 335

See application file for complete search history.

(56) References Cited

U.S. PATENT DOCUMENTS

| | | | | |
|---|---|---|---|---|
| 935,631 | A * | 10/1909 | Adkins | 198/328 |
| 3,842,961 | A | 10/1974 | Bruson | |
| 4,240,537 | A * | 12/1980 | Dunstan | 198/334 |
| 4,509,429 | A | 4/1985 | De Broqueville | |
| 6,675,949 | B1 * | 1/2004 | Gonzalez Alemany et al. | 198/334 |
| 7,063,203 | B2 * | 6/2006 | Gonzalez Alemany et al. | 198/334 |
| 2005/0217970 | A1 | 10/2005 | Gonzalez Alemany et al. | |

FOREIGN PATENT DOCUMENTS

| | | |
|---|---|---|
| EP | 1 582 494 | 10/2005 |
| ES | 2 272 118 | 4/2007 |
| JP | 2003321185 A * | 11/2003 |

* cited by examiner

*Primary Examiner*—Mark A Deuble
(74) *Attorney, Agent, or Firm*—Merchant & Gould P.C.

(57) ABSTRACT

The invention relates to a carriage for driving handrails of walkways and moving stairs, comprising a body (6) in the form of a vertical plate in which leading rollers (7) are assembled; two swinging locking pawls (12-13) for locking with a drive chain; a free turning wheel (24) intended to be supported against a cam profile in order to cause the pawls (12-13) to swing between an operative vertical position and an inoperative horizontal position; and an arm (8) intended to engage with the variable pitch screws.

3 Claims, 7 Drawing Sheets

CARRIAGE FOR DRIVING HANDRAILS OF WALKWAYS AND MOVING STAIRS

The present invention relates to a carriage for driving handrails of walkways and moving stairs, and more specifically for driving handgrips of variable speed handrails, intended for walkways and stairs including end sections with slow speed movements and an intermediate section with a faster movement, between both of which the walkway and the handgrips of the handrail must move at a variable speed.

BACKGROUND OF THE INVENTION

Spanish patent application No. 200400773 of the same applicants describes a variable speed handrail for variable speed walkways and mechanical stairs, which are formed by a flexible profile circulating along the walkway or stairs and moving all along its path at a constant speed, and by many independent handgrips coupled on the flexible profile moving at a speed considerably equal to the speed of the transporting plates closest to the walkway or stairs, so that they will have to move at a slow speed in some sections, at a faster speed in other sections and at a variable speed in intermediate sections.

The handrail previously mentioned comprises a series of carriages with a handgrip joined to each one of them. Each carriage is driven along the path of the handrail and bears means for locking and unlocking the carriage to a drive chain of the handrail at a constant speed and to couple and uncouple the carriage to a variable pitch screw in order to move said carriage at a variable speed. These means are actuated by means of a horizontal axis free turning wheel which is assembled in the body of the carriage and is intended to be supported against a cam profile of the guide, located in the sections in which the transition from movement at a constant speed to a variable speed is to occur.

The carriage is formed by a vertical plate bearing horizontal axis leading rollers supported on a guide next to the handrail, running therein, to drive said carriage along the path of the handrail.

The means for locking and unlocking the carriage to the drive chain at a constant speed consists of a locking tooth which can be moved linearly in a vertical direction, between a locking or an active upper position, in which said tooth is anchored to the drive chain, and a lower position, in which said tooth is separated and unlocked from the chain. In the second position mentioned, the unlocking position, the coupling of the carriage to one of the variable pitch screws of the walkway arranged in variable speed sections occurs. To that end, the carriage bears an arm laterally projecting from the plate forming the body of said carriage and is positioned so that it is coupled or engaged with the screws when the carriages move in coincidence with the positions of these screws, in which the unlocking of the tooth in relation to the chain also occurs.

As has been indicated, the locking and unlocking of the carriage with the drive chain of the handrail is carried out by means of the linear movement of a tooth, which movement can present operative problems for the carriage.

Furthermore, the carriage described above must have auxiliary parts for supporting the rollers of the chain in the unlocking position between carriage and chain.

SUMMARY OF THE INVENTION

The object of the present invention is to eliminate the drawbacks set forth by means of a carriage in which the locking and unlocking of the carriage with the chain is carried out with a mechanism in which the linear movement is replaced with rotational movements, which are operatively safer.

In addition, in the carriage of the invention the elements through which the locking and unlocking of the carriage to the chain is obtained serve to support the pulley wheels of the chain in the unlocking situation, thus eliminating the auxiliary parts necessary in carriages of traditional handrails for this purpose.

According to the invention, in the carriage for driving handgrips of the handrail, the locking and unlocking means for locking and unlocking with the chain are formed by two swinging pawls and by two actuating levers of said pawls.

The pawls are linked to the body of the carriage according to first horizontal pins, located at the same height, around the pins of which the pawls can swing between an operative vertical position, in which they project from the body at the upper part and are introduced between two consecutive pulley wheels of the drive chain, and an inoperative horizontal position, in which they are aligned and establish a support track at the upper part for the pulley wheels of the chain.

In turn the levers through which the pawls are actuated are linked to one another at an intermediate point by means of a second horizontal pin which is assembled in the body of the carriage by means of a central vertical slide located below the linkage points of the pawls of the carriage. By means of this slide the second pin linking the two levers can move vertically between the upper and lower limit positions. At their upper end, each one of these mentioned levers is linked to a pawl, according to third pins 23 at symmetrical points located inside and below the linkage points of the pawls with the body of the carriage in the inoperative position of said pawls, whereas they are located inside and above the mentioned linkage points of the pawls in the operative position of said pawls.

Passing from one position to another is achieved by means of the rotation of the pawls on the first linkage pins for linking the pawls with the body of the carriage and by the movement according to an arched path of the third linkage pins between levers and pawls.

One of the actuating levers of the pawls has at least the free turning wheel assembled at its lower end, which wheel will be supported against the cam profile of the guide to vertically move the second linkage pin of the levers in the previously mentioned vertical movement slide between the upper and lower limit positions which correspond to the operative and inoperative positions of the pawls.

In order to assure the operative and inoperative positions of the pawls, the two actuating levers of said pawls have assembled at their lower end a compression spring pushing said levers towards one of the end positions when exceeding an intermediate balance point or position.

The slide in which the linkage pin of the two levers is assembled can consist of a vertical groove which is formed in the body of the carriage. The mentioned second pin passes through or traverses this groove, which pin on one side links the two levers and on the opposite can be finished with a head or have a plate acting as a stop assembled thereto.

BRIEF DESCRIPTION OF THE DRAWINGS

The features, set-up and operation of the carriage of the invention are explained below in greater detail with the aid of the attached drawings, in which a non-limiting embodiment is shown.

In the drawings.

DETAILED DESCRIPTION OF THE PREFERRED EMBODIMENT(S)

Figure 1:
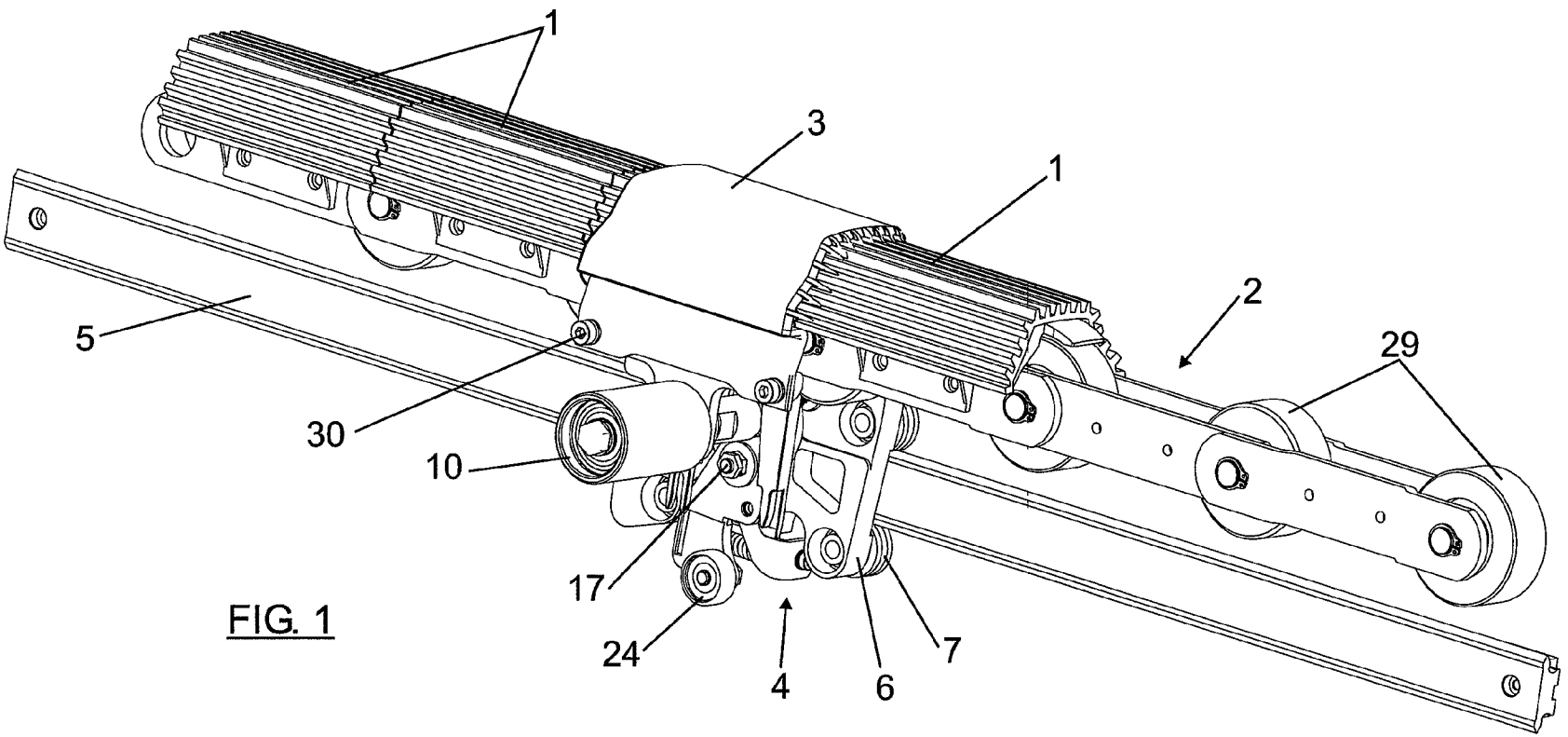
FIG. 1 is a partial perspective view of a handrail on which a handgrip joined to the carriage of the invention is shown.
Figure 2:
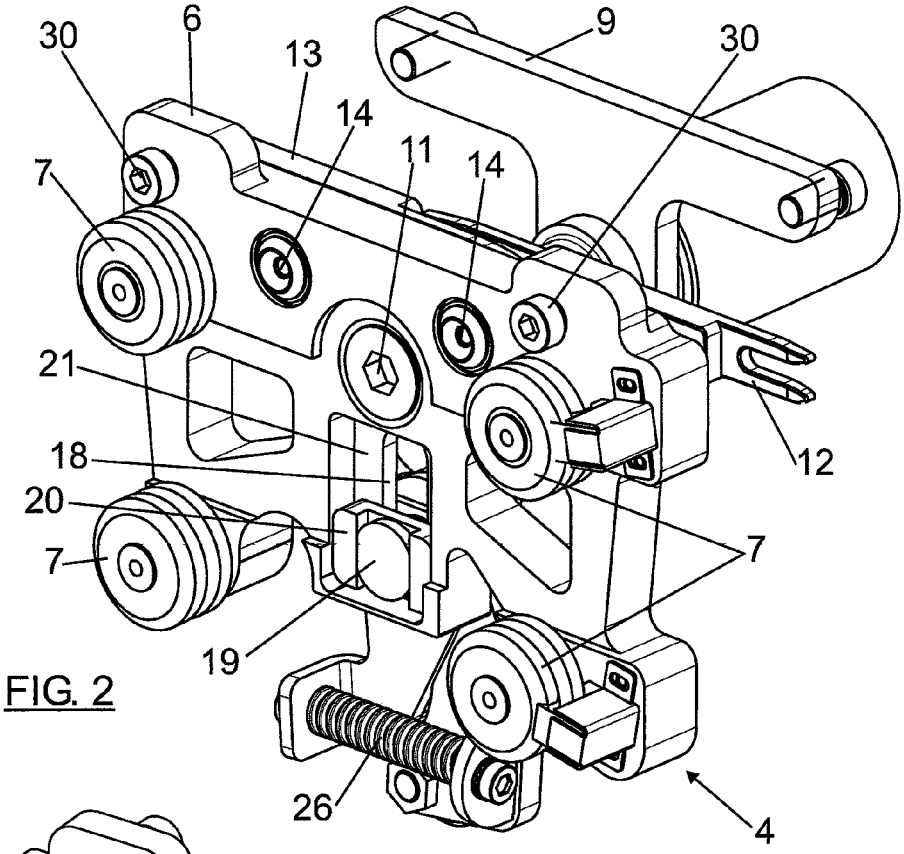
FIG. 2 is a rear perspective view of the carriage of the invention, with the pawls in the inoperative position.
Figure 3:
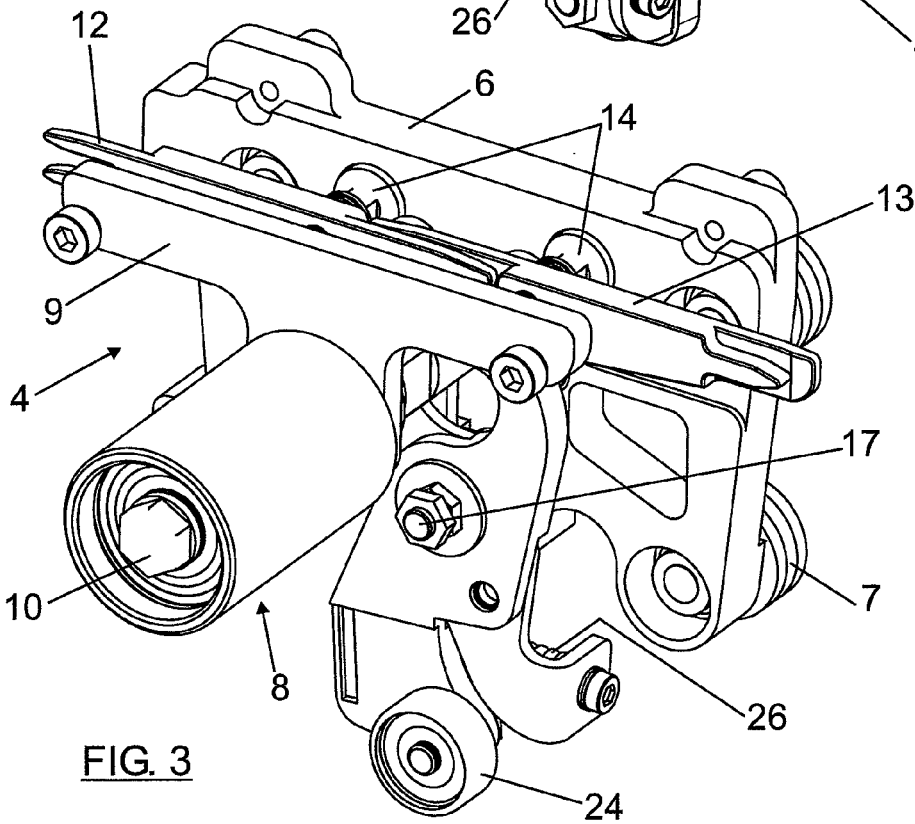
FIG. 3 is a front perspective of view the carriage, with the pawls in the position of FIG. 2.

FIGS. 2 and 3 show, respectively, rear and front perspective views of the carriage 4 comprising a body 6 formed by a flat vertical plate, which has assembled on the rear surface thereof four horizontal axis leading rollers 7 which are intended to be supported on the guide 5 (FIG. 1) next to the forward movement and return sections of the handrail, running therein. The carriage 4 also bears an arm 8, projecting from the front side of the body 6 and preferably consisting of a free turning roller anchored to the body 6, for example by means of a bolt or pin 10 introduced through the opening 11 of the body 6 and further serving as a support of the plate 9 to which the handgrips 3 of the handrail are fixed.

Figure 4:
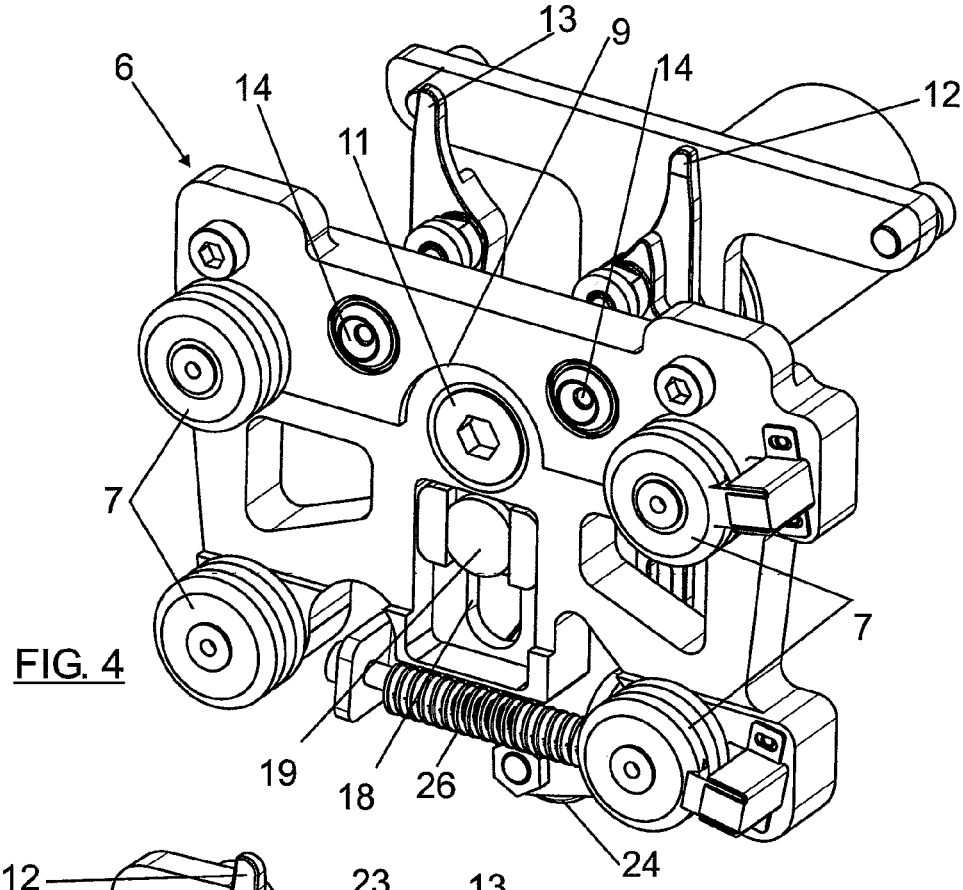
FIG. 4 is a view similar to FIG. 2, with the pawls in the active or locking position.
Figure 5:
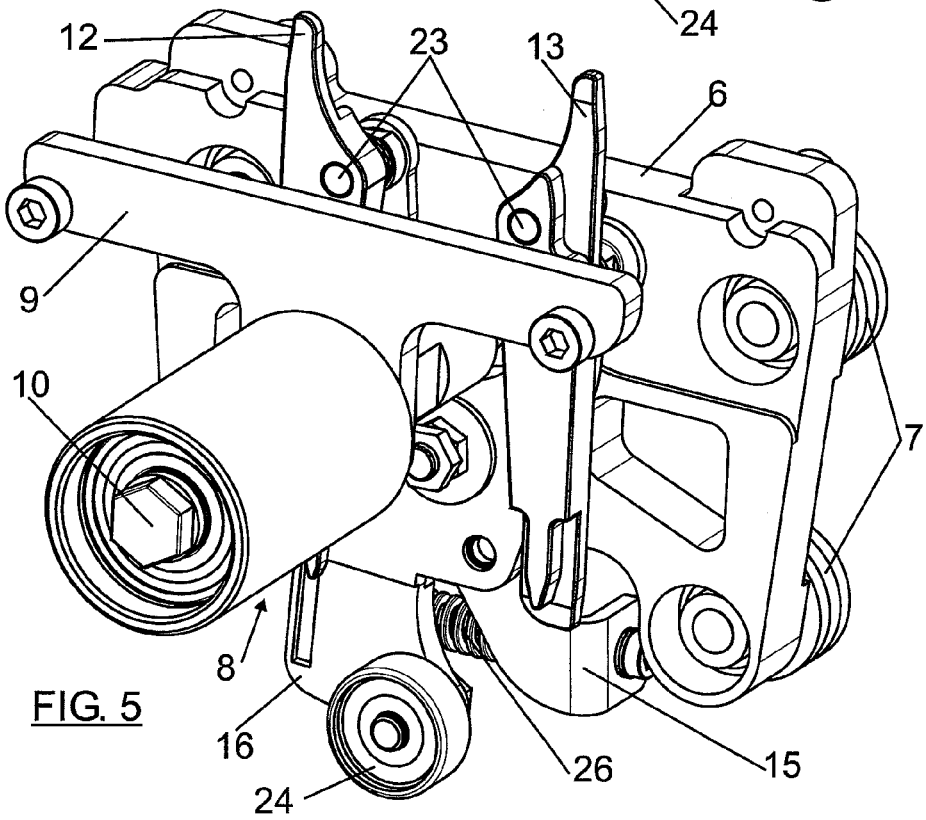
FIG. 5 is a view similar to FIG. 3, with the pawls in the locking position.

On the front side of the body 6, between the latter and the plate 9, two swinging pawls 12 and 13 are linked according to first horizontal linkage pins 14 located at the same height. These pawls can swing between an inoperative position, shown in FIGS. 2 and 3, in which they are aligned in the horizontal position, and a locking position, shown in FIGS. 4 and 5, in which they are in a vertical position.

Figure 6:
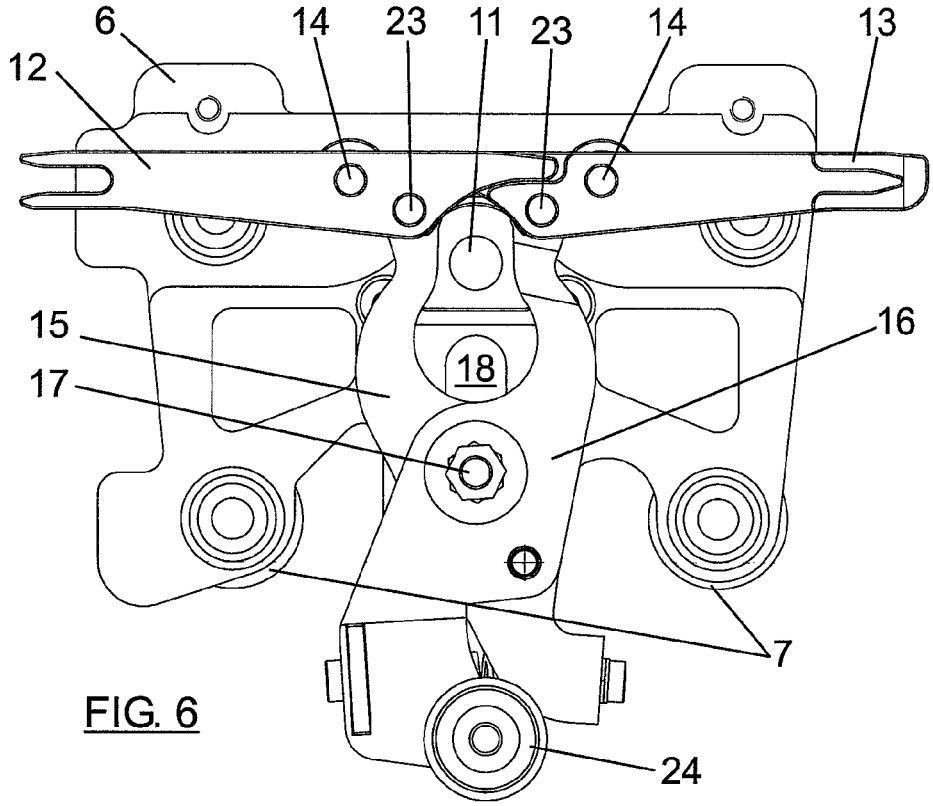
FIG. 6 is a front elevational view of the carriage, with the pawls in the inoperative position and in which the coupling arm for coupling with the screw and support thereof has been eliminated.

FIG. 6, in which the arm 8 and the plate 9 have been eliminated, shows the pawls 12 and 13 in an inoperative horizontal position. The actuation of these pawls is carried out by means of two levers 15 and 16 which are linked to one another according to a second horizontal pin 17 which is assembled in the body 6 through a vertical slide formed, as can be better seen in FIGS. 2 and 3, by a central vertical groove 18 through which the second pin 17 passes to be finished with a head 19 retained by a plate 20 which is housed in a slot 21 formed around the vertical groove 18. The second linkage pin 17 between levers 15 and 16 can move vertically along the vertical groove 18. At their upper end, each one of the levers 15 and 16 is linked to one of the pawls 12 and 13 according to third linkage pins 23 parallel to the first linkage pins 14 between the pawls and the body 6. One of the levers, the lever with reference number 16 in the example described, bears at the lower end a free turning wheel 24 which in the speed change sections of the handgrips 3 of the handrail, as described below with reference to FIG. 12, is intended to be supported on a cam profile 25, which will push the wheel 24 upwards or downwards in order to move the second linkage pin 17 of the two levers in the same direction, causing the effect that is explained below with reference to FIGS. 7 to 9.

In the assembly of pawls and levers the only fixed points are those with reference number 14, corresponding to the first linkage pins for linking the pawls 12 and 13 with the body 6. When the wheel 24 moves up or down by the action of the cam profile 25, FIG. 12, the second pin 17 will move in the same direction on the vertical groove 18 and the linkage pins 23 between levers and pawls will outline a circular path around the first linkage pins 14. The levers 15 and 16 will rotate around the second linkage pin 17 between said levers, which pin, as mentioned, is not fixed, but rather moves along the vertical groove 18.

Figure 7:
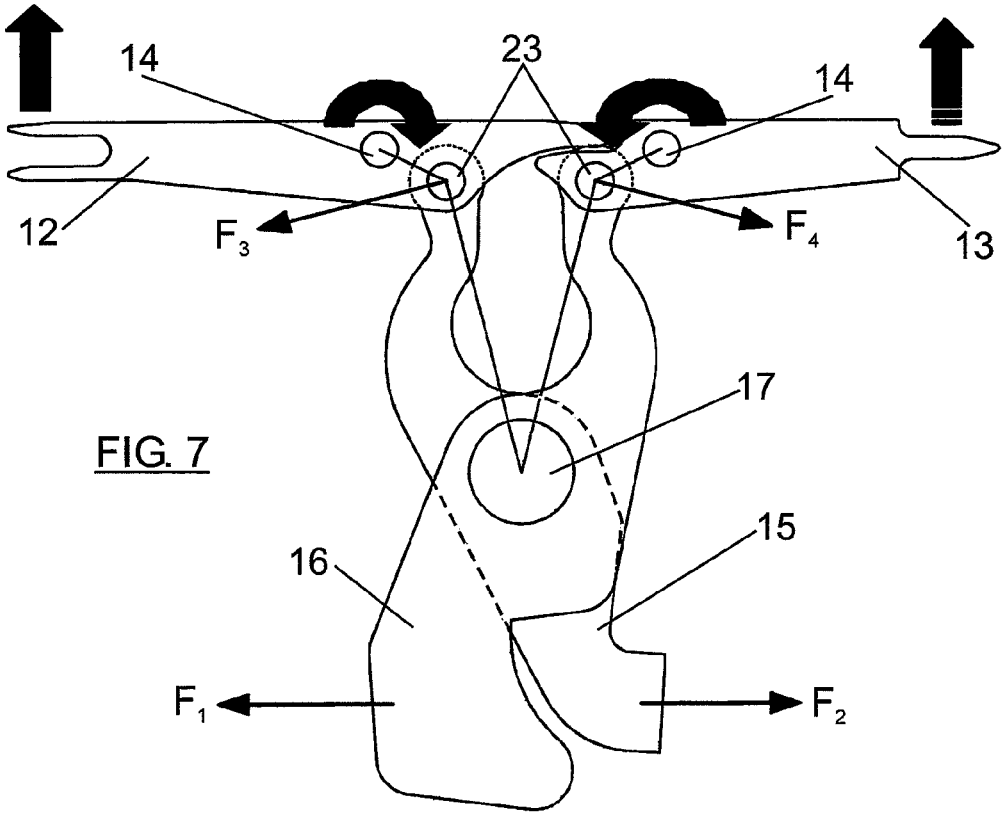
FIG. 7 shows a frontal elevational view of the swinging pawls and actuating levers forming the locking means for locking the carriage of the invention with the drive chain, with the pawls in the unlocking position.

Assembled between the lower ends of the levers 15 and 16 there is a compression spring 26 (FIGS. 2, 4, 5, 10 and 12) that is compressed at all times and tends to separate the lower ends of the levers from the position of FIG. 7 with forces $F_1$ and $F_2$, giving the resulting forces $F_3$ and $F_4$ in the third linkage pins 23 between the levers 15 and 16 and the pawls 12 and 13, keeping this position of FIG. 7 stable, which position corresponds to the inoperative position of the pawls 12 and 13, in which the third linkage pins 23 are located inside and slightly below the first linkage pins 14 between the pawls 12 and 13 and the body 6, whereby the direction of the moment of rotation is indicated with the curved arrows.

Figure 8:
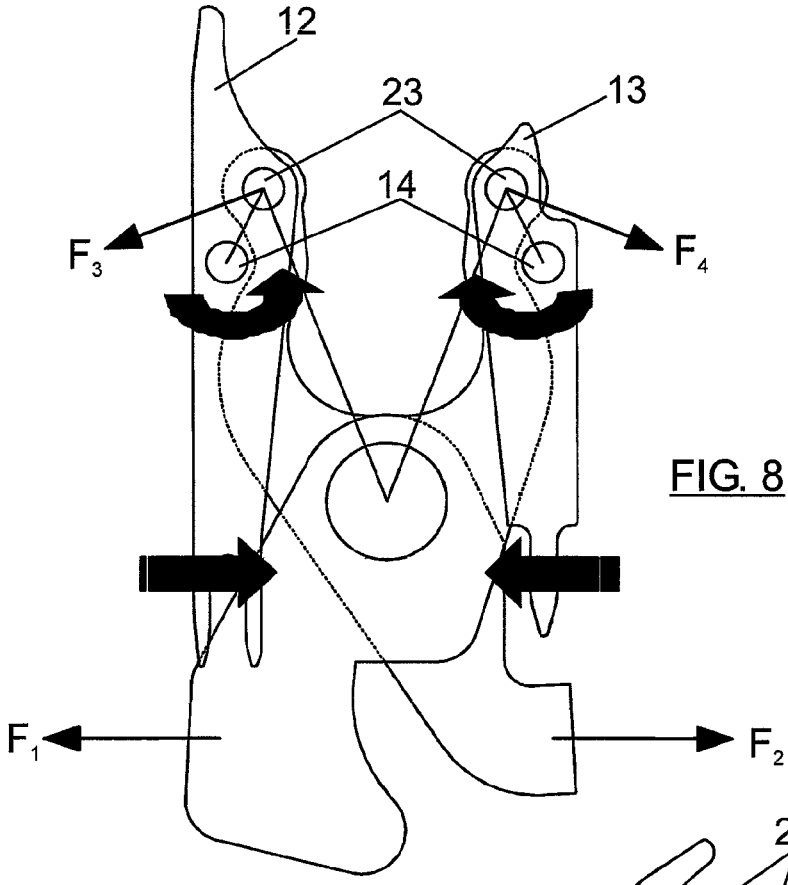
FIG. 8 is a view similar to FIG. 7, with the pawls in the locking position.
Figure 12:
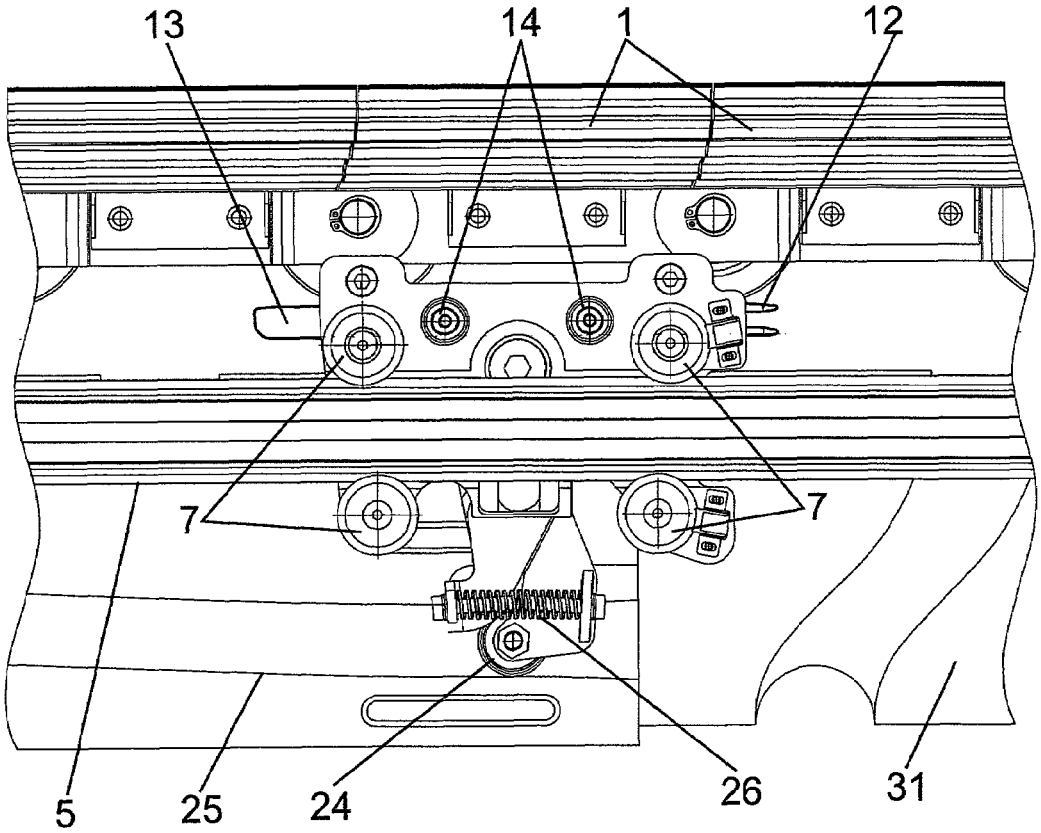
FIG. 12 shows a rear elevational view of the assembly of FIG. 11.

From this position the inclined surface of the cam profile 25, FIG. 12, pushes the wheel 24 upwards, moving the second linkage pin 17 upwards as well, FIG. 6, through the vertical groove 18. This rise causes the application point of the forces $F_3$ and $F_4$ to be raised little by little until being located above the points defined by the first pins 14, as shown in FIG. 8. The spring 26 continues acting in the same direction according to $F_1$ and $F_2$ and the points defined by third linkage pins 23 between levers and pawls are located inside and above the points defined by the first linkage pins 14 between the pawls 12 and 13 and the body 6, whereby the moment has an opposite rotating direction, with regard to FIG. 7, which favors reaching the final position or, if the movement is initiated from this position to the initial position, it would oppose said movement, thus assuring the locking in this position of FIG. 8.

In other words the locking of the pawls in the two limit positions, the inoperative position of FIG. 7 and the locking position of FIG. 8, is assured with the spring 26.

Figure 9:
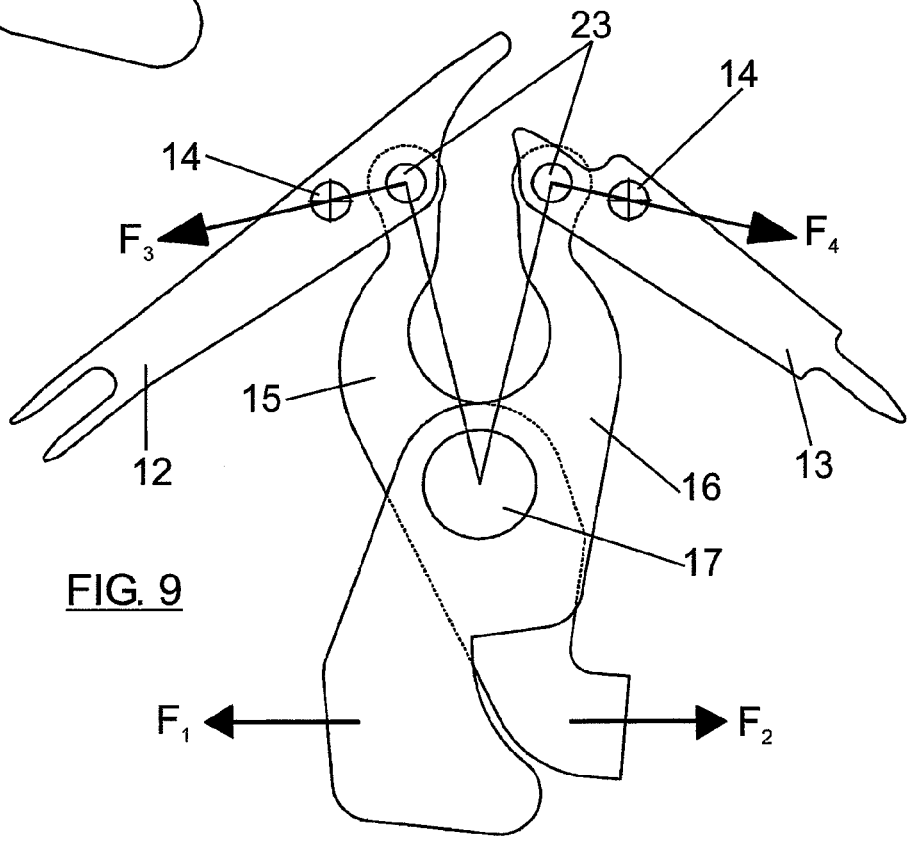
FIG. 9 is a view similar to FIGS. 7 and 8, with the pawls in an intermediate position between the locking and unlocking positions.

The inflection point in the behavior of the spring corresponds to the moment that the direction of the forces $F_3$ and $F_4$ passes through the first linkage pins 14 between pawls 12 and 13 and the body 6, as shown in FIG. 9, in which moment the behavior of the spring 26 does not affect the movement of the pawls 12 and 13. The wheel 24 forces the system to leave this "neutral" position, given that the rolling path thereof, defined by the cam profile 25, makes it continue to rise and therefore the second linkage pin 17 between the levers 15 and 16 does as well.

Figure 10:
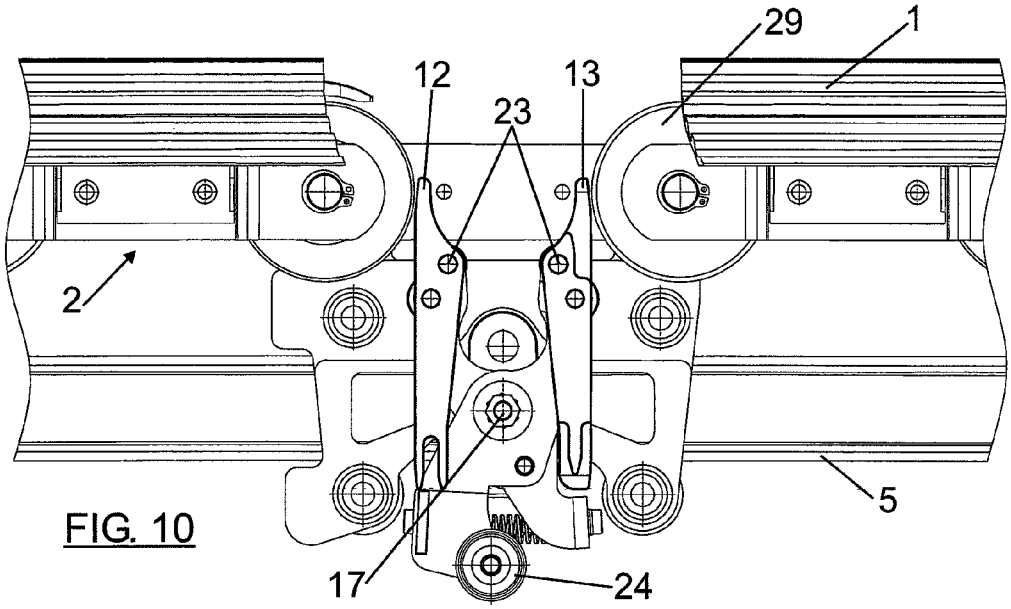
FIG. 10 is a view similar to FIG. 6, showing the carriage assembled on the handrail and with the pawls in the locking position.

In FIG. 10 it can be observed that when the pawls 12 and 13 are in their vertical operative position, they are introduced between consecutive pulley wheels 29 of the drive chain 2, below which chain the guide 5 leading the carriage 4 runs. In this position the chain to which the pulley wheels 29 belong will drive the carriage 4 and with it the handgrips 3, FIG. 1, coming to form a part of the handrail and each of which is fixed to a carriage 4 by means of bolts 30, FIGS. 1 and 2. In this situation the handgrips 3 will move at the same speed as the chain to which the pulley wheels 29 belong.

Figure 11:
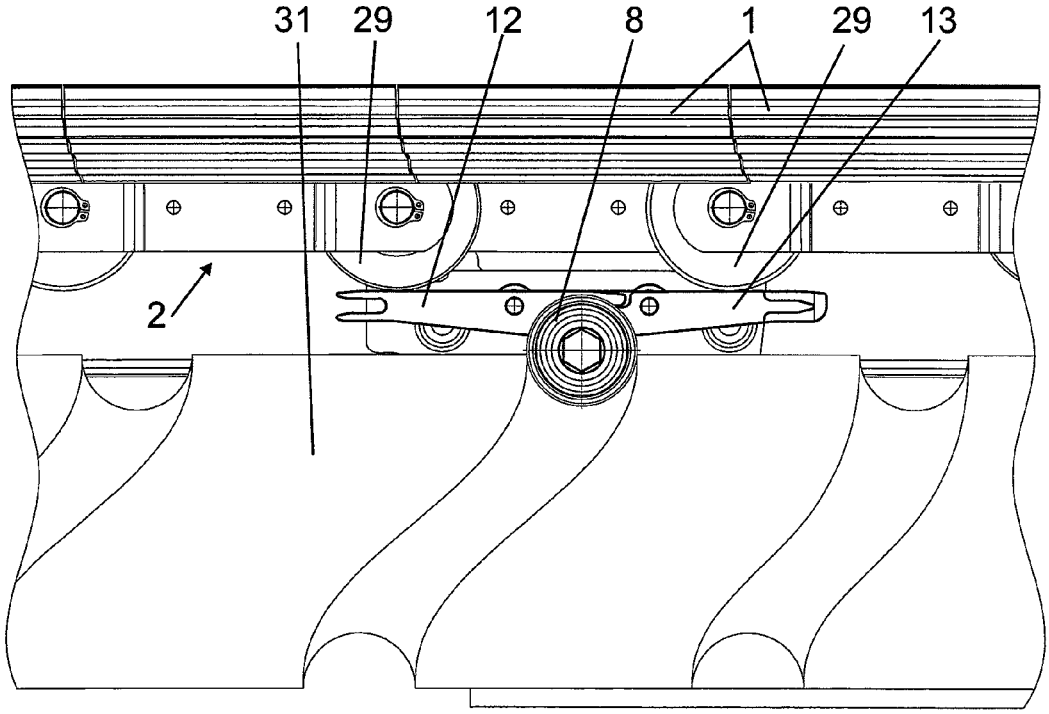
FIG. 11 is a view similar to FIG. 10, showing the pawls in the unlocking position.

When one of the carriages reaches one of the areas in which a change of speed must occur, the free turning wheel 24 is supported on the cam profile, FIG. 12, causing the pawls 12 and 13 to swing from the position of FIG. 12 to the position of FIG. 10, as has already been described. In this moment the arm 8 is coupled on the variable pitch screw 31, as shown in FIG. 11, which causes the variation of the speed of the carriage 4 and with it the variation of the handgrip 3 of the handrail associated to said carriage. As can be observed in FIG. 11, in this position the pawls 12 and 13 are in a horizontal position, the upper edge thereof defining a track for the support and movement of the pulley wheels 29 of the chain 2.

The invention claimed is:

1. A carriage for driving handrails of walkways and moving stairs, comprising a body in the form of a vertical plate in which horizontal axis leading rollers are assembled for being supported on a guide next to the handrail, running therein; locking means for locking with a drive chain for the handrail; a free turning wheel intended to be supported against a cam profile of the guide to move the locking means from an operative position, in which it fixes the carriage to the chain, and an inoperative position, in which they release the carriage from said chain; and an arm horizontally projecting from the plate to engage with the variable pitch screws, wherein the mentioned locking means are formed by two pawls and by two actuating levers of said pawls; the pawls of which are linked to the body of the carriage according to first horizontal pins, around which they can swing between an operative vertical position, in which they project from the body at the upper part to be introduced between two consecutive pulley wheels of the drive chain, and an inoperative horizontal position, in which they are aligned and establish a support track for said pulley wheels at the upper part; and the actuating levers of which are linked to one another at an intermediate point by means of a second horizontal pin which is assembled in the body of the carriage by means of a vertical slide, located below the linkage points of the pawls to the carriage, through which it can move vertically, whereas at the upper end each lever is linked to a pawl by means of third symmetrical and parallel pins located inside and below the first linkage pins for linking said pawls with the body of the carriage in the inoperative position of the pawls, and inside and above the mentioned linkage points of the pawls in the operative position; at least one of the levers bearing at its lower end the free turning wheel which will be supported against the mentioned cam profile to vertically move the second linkage pin of said levers in the mentioned vertical slide between upper and lower limit positions, corresponding to the operative and inoperative positions of the pawls, the levers further having a compression spring assembled between their lower ends, which spring is kept tensed whatever the position of said levers may be.

2. A carriage according to claim 1, wherein the slide in which the second linkage pin of the levers is assembled consists of a vertical groove formed in the body of the carriage, through the groove of which said pin passes.

3. A carriage according to claim 1, wherein the mentioned two levers intersect one other in their central part, the second linkage pin between said levers being located in this intersection area.

* * * * *